US005683847A

United States Patent [19]

Patel et al.

[11] Patent Number: 5,683,847

[45] Date of Patent: Nov. 4, 1997

[54] TONER AGGREGATION LATEX PROCESSES

[75] Inventors: Raj D. Patel, Oakville; Grazyna E. Kmiecik-Lawrynowicz, Burlington; Walter Mychajlowskij, Georgetown; Michael A. Hopper, Toronto, all of Canada

[73] Assignee: Xerox Corporation, Stamford, Conn.

[21] Appl. No.: 619,055

[22] Filed: Mar. 20, 1996

[51] Int. Cl.[6] ..... G03G 9/087

[52] U.S. Cl. ..... 430/137; 430/110

[58] Field of Search ..... 430/137, 115, 430/109, 110

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,344,738 | 9/1994 | Kmieco-Lawrynowicz et al. | 430/137 |
| 5,536,615 | 7/1996 | Hopper et al. | 430/137 |

*Primary Examiner*—John Goodrow
*Attorney, Agent, or Firm*—E. O. Palazzo

[57] ABSTRACT

A process comprising:

(i) preparing a pigment dispersion, which dispersion is comprised of a pigment, a cationic surfactant, and optionally a charge control agent;

(ii) shearing said pigment dispersion with a latex comprised of water, resin, a counterionic or anionic surfactant with a charge polarity of opposite sign to that of said cationic surfactant, and a nonionic surfactant, and wherein said latex is prepared by the addition of monomers containing a chain transfer agent and a organic soluble initiator to a water phase containing a anionic surfactant, and said nonionic surfactant, followed by the addition of a water soluble initiator, and subsequently heating;

(iii) heating the above sheared blend below about the glass transition temperature (Tg) of the resin to form electrostatically bound toner size aggregates; and (iv) heating said bound aggregates above about the Tg of the resin.

43 Claims, No Drawings

TONER AGGREGATION LATEX PROCESSES

BACKGROUND OF THE INVENTION

The present invention is generally directed to toner processes, and more specifically, to the preparation of a latex or resin selected for aggregation and coalescence processes for the preparation of toner compositions. In embodiments, the present invention is directed to the economical preparation of the resin component of the toners, which toners can be generated without the utilization of the known pulverization and/or classification methods, and wherein in embodiments toner compositions with a volume average diameter of from about 1 to about 25, and preferably from 1 to about 10 microns, and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a process for the preparation of an anionically charged latex (which is essentially a resin particle suspended in water by virtue of its method of preparation using a suitable dispersant or surfactant) utilizing both water soluble initiators and organic soluble initiators (the water soluble initiator in embodiments provides for the surface charge on the latex, which latex is not substantially effected by the oil soluble initiator which is substantially less ionic in nature), and wherein the latex can be selected for the preparation of toner particles of resin and pigment by combining the latex with a dispersion of pigment and optionally toner additives like a charge control agent or additives in an aqueous mixture containing a surfactant, such as cationic surfactant, in an amount of from about 0.5 percent (weight percent, or parts throughout unless otherwise indicated) to about 10 percent and shearing this mixture with the prepared latex mixture comprised of suspended submicron resin particles of from, for example, about 0.01 micron to about 1 micron in volume average diameter in an aqueous solution containing an anionic surfactant, which anionic surfactant is selected in various effective amounts, such as from about 1 percent to about 10 percent, and a nonionic surfactant in various effective amounts such as from about 0 percent to about 5 percent. The resultant flocculation of resin particles, pigment particles and the optional additives is then vigorously mixed under conditions of high speed shearing, followed by heating at about 5° C. to about 40° C. below the resin Tg, and preferably about 5° C. to about 25° C. below the resin Tg while stirring of the flocculent mixture thereby forming electrostatically bound aggregates of from about 1 micron to about 10 microns in volume average diameter, and which aggregates are comprised of particles of resin, pigment and optional charge control additive, followed by the addition of a size stabilizer, and thereafter, heating the formed bound aggregates about above the Tg (glass transition temperature) of the resin. The addition of the stabilizer, such as an anionic surfactant, can prevent any further growth in size of the aggregates during the process of heating above the glass transition step of the resin to coalesce the aggregates into mechanically stable particles suitable for application as electrophotograhic toners. The size of the aforementioned statistically bonded aggregated particles can be controlled by adjusting the temperature applied in that part of the process where the system is maintained below the Tg of the resin. An increase in the temperature in this step of the process can cause an increase in the size of the aggregated particle. Subsequent heating of the mixture above the resin Tg generates toner particles with, for example, an average particle volume diameter of from about 1 to about 25 and preferably from 1 to 10 microns. It is believed that during the heating stage the components of aggregated particles coalesce together to form composite toner particles. In another embodiment thereof, the present invention is directed to an in situ chemical process comprised of first dispersing a pigment, such as SUNSPERSE BLUE™, reference the Color Index, in an aqueous mixture containing a cationic surfactant, such as dodecyl benzyl, or dimethyl ammonium chloride (SANIZOL B-50™), utilizing a high shearing device, such as a Brinkmann Polytron, microfluidizer or sonicator, thereafter shearing this mixture with a latex prepared as illustrated herein and comprised of suspended resin particles, such as poly(styrene butadiene acrylic acid), poly(styrene butylacrylate acrylic acid), or poly(styrene isoprene acrylic acid), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate, for example NEOGEN R™ or NEOGEN SC™, and a nonionic surfactant such as alkyl phenoxy poly(ethylenoxy)ethanol, for example IGEPAL 897™ or ANTAROX 897™, thereby resulting in a flocculation, or heterocoagulation of the resin particles with the pigment particles; and which, on further stirring for about 1 to about 3 hours while heating, for example, from about 35° C. to about 45° C., results in the formation of statically bound aggregates ranging in size of from about 1.0 micron to about 10 microns in volume average diameter size as measured by the Coulter Counter (Microsizer II), where the size of those aggregated particles and their distribution can be controlled by the temperature of heating, for example from about 5° C. to about 25° C. below the resin Tg. Thereafter, adding a colloidal stabilizer, such as additional anionic surfactant, such as sodium dodecylbenzene sulfonate, for example NEOGEN R™ or NEOGEN SC™, in an amount between 0.2 and 2 percent, or parts by weight of the aggregate suspension to prevent further growth of the aggregates and heating the aggregate suspension from about 5 to about 50° C. above the resin Tg provides for particle fusion or coalescence of the polymer and pigment particles; followed by optional washing with, for example, water to remove surfactant; and drying whereby toner particles comprised of resin and pigment with various particle size diameters can be obtained, such as from 1 to about 20 microns, and preferably from about 2 to 10 microns in volume average particle diameter. The aforementioned toners are especially useful for the development of colored images with excellent line and solid resolution, and wherein substantially no background deposits are present.

Emulsion/aggregation processes for the preparation of toners are illustrated in a number of Xerox Corporation patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. The latex prepared in accordance with the processes of the present invention can be selected for the preparation of toner particles as illustrated in the above mentioned patents.

Of interest may be U.S. Pat. Nos. 4,996,127; 4,983,488 and 4,558,108.

SUMMARY OF THE INVENTION

Examples of objects of the present invention include:

It is an object of the present invention to provide for the preparation of a latex, and toner processes thereof with many of the advantages illustrated herein.

In another object of the present invention there are provided simple and economical processes for the direct preparation of a latex for use in the preparation of black and colored toner compositions with, for example, excellent pigment dispersion and narrow GSD of, for example, about 1.2 to about 1.4.

In another object of the present invention there are provided processes for the preparation of a resin latex wherein the percent by weight of monomer and/or oligomer is reduced thereby avoiding, or minimizing severe pigment diffusion into the aqueous phase during aggregation and coalescence which causes undesirable low optical density toner particles to form and can present an aqueous disposal problem. Thus, with the processes of the present invention in embodiments undesirable pigment migration is avoided, or minimized, and gloss of the developed electrostatic image can be reduced or avoided.

In a further object of the present invention there is provided a process for the preparation of toner compositions with certain effective particle sizes by controlling the temperature of the aggregation which process comprises stirring and heating about below the resin glass transition temperature (Tg), and in embodiments the avoidance or minimization of low molecular weight oligomers, such as those with a $M_w$ of from about 100 to about 2,000, therefore, low Tg components of, for example, between 45° C. and 50° C., which can cause premature coalescence of toner aggregates resulting, for example, in a volume average GSD (geometric standard deviation) of greater than 1.30, particularly at the high particle size end of the distribution, can be minimized.

These and other objects of the present invention are accomplished in embodiments by the provision of toners and processes thereof. In embodiments of the present invention, there are provided processes for the economical direct preparation of toner compositions by improved flocculation, or heterocoagulation and coalescence, and wherein the temperature of aggregation can be utilized to control the final toner particle size, that is volume average diameter, and wherein certain latexes are selected.

Embodiments of the present invention include a process comprising:

(i) preparing a pigment dispersion, which dispersion is comprised of a pigment, a cationic surfactant, and optionally a charge control agent;

(ii) shearing said pigment dispersion with a latex comprised of water, resin, a counterionic or anionic surfactant with a charge polarity of opposite sign to that of said cationic surfactant and a nonionic surfactant, and wherein said latex is prepared by the addition of monomers containing said chain transfer agent and said organic soluble initiator to a water phase containing said anionic surfactant, and said nonionic surfactant, followed by the addition of said water soluble initiator, and subsequently heating;

(iii) heating the above sheared blend below about the glass transition temperature (Tg) of the resin to form electrostatically bound toner size aggregates; and (iv) heating said bound aggregates above about the Tg of the resin; a process for the preparation of toner particles comprising:

(i) preparing a pigment dispersion, which dispersion is comprised of a pigment and a cationic surfactant;

(ii) shearing said pigment dispersion with a latex comprised of water, resin, a counterionic or anionic surfactant with a charge polarity of opposite sign to that of said cationic surfactant and a nonionic surfactant, and wherein said latex is prepared by the addition of monomers containing said chain transfer agent and said organic soluble initiator to a water phase containing said anionic surfactant, and said nonionic surfactant, followed by the addition of said water soluble initiator, and subsequently heating;

(iii) heating the above sheared blend below the glass transition temperature (Tg) of the resin to form electrostatically bound toner size aggregates with a narrow particle size distribution;

(iv) adding further anionic surfactant in an amount of from about 0.5 to about 5 weight percent;

(v) heating for a period of from about 0.5 to about 5 hours said bound aggregates above the Tg of the resin; and (vi) isolating and drying said toner particles; a process for the preparation of a latex which comprises the addition of monomers containing a chain transfer agent and an organic soluble initiator to a water phase containing water, anionic surfactant, and nonionic surfactant, adding a water soluble initiator, and thereafter heating; a process for the preparation of a latex by a microsuspension polymerization process which comprises (i) adding monomers to be reacted at a concentration between 20 and 50 percent of the final weight of the aqueous dispersion together with between 0.5 and 5 percent by weight of a chain transfer agent or agents, and between 0.2 and 5 percent of an oil soluble initiator to an aqueous mixed surfactant solution of anionic and nonionic surfactants where the total surfactant concentration is between 0.5 and 5 percent;

(ii) blending the dispersion of (i) under conditions of high shear of between 5,000 and 15,000 rpm to form a fine oil in water suspension, thereafter adding between 1 and 5 percent of a water soluble initiator to this sheared emulsion; and (iii) heating the above emulsion to between 60° C. and 80° C. while stirring gently for between about 4 and about 10 hours to form the latex as a polymerized resin in suspension, or a polymerized resin in an emulsion, wherein said resin results from said monomer; and a process wherein the latex is prepared by (i) adding monomers to be reacted at a concentration of between about 20 to about 50 weight percent, or parts of the final weight of the aqueous dispersion together with between about 0.5 and about 5 percent, or parts by weight of a chain transfer agent or agents and between about 0.2 and about 5 percent of an oil soluble initiator to an aqueous mixed surfactant solution of an anionic and a nonionic surfactant where the total surfactant concentration is between about 0.5 and about 5 percent, or parts and, thereafter, adding between about 1 and about 5 percent, or parts, of a water soluble initiator;

(ii) heating the above dispersion to between about 60° C. and about 80° C. while stirring gently for between about 4 and about 10 hours to form a latex as a polymerized resin in suspension; a process wherein the latex is prepared by a microsuspension polymerization process which comprises:

(i) adding the monomers, such as from 2 to about 10, to be reacted at a concentration of between 20 and 50 percent of the final weight of the aqueous dispersion together with between 0.5 and 5 percent by weight of a chain transfer agent or agents, such as two agents and between 0.2 and 5 percent of an oil soluble initiator, to an aqueous mixed surfactant solution of anionic and nonionic surfactants where the total surfactant concentration is between 0.5 and 5 percent;

(ii) blending the above dispersion under conditions of high shear of between 5,000 and 15,000 rpm to form a fine oil in water suspension, thereafter, adding between 1 and 5 percent of a water soluble initiator, or water soluble initiator mixture containing sufficient water to dissolve the initiator to the sheared emulsion (i); and (ii) heating the above emulsion to between 60° C. and 80° C. while stirring gently for between about 4 and about 10 hours to form a latex as a polymerized resin in suspension; a process comprising:

(i) preparing a pigment dispersion, which dispersion is comprised of a pigment, a cationic surfactant, and optionally a charge control agent;

(ii) shearing said pigment dispersion with a latex comprised of water, resin, a counterionic or anionic surfactant with a charge polarity of opposite sign to that of said cationic surfactant and a nonionic surfactant, and wherein said latex is prepared by the addition of monomers containing said chain transfer agent and said organic soluble initiator to a water phase containing said anionic surfactant and said nonionic surfactant, followed by the addition of said water soluble initiator, and subsequently heating;

(iii) heating the above sheared blend below about the glass transition temperature (Tg) of the resin to form electrostatically bound toner size aggregates; and (iv) heating said bound aggregates above about the Tg of the resin; and a process for the preparation of toner particles comprising:

(i) preparing a pigment dispersion, which dispersion is comprised of a pigment and a cationic surfactant;

(ii) shearing said pigment dispersion with a latex comprised of water, resin, a counterionic or anionic surfactant with a charge polarity of opposite sign to that of said cationic surfactant, and a nonionic surfactant, and wherein said latex is prepared by the addition of monomers containing said chain transfer agent and said organic soluble initiator to a water phase containing said anionic surfactant and said nonionic surfactant, followed by the addition of said water soluble initiator, and subsequently heating;

(iii) heating the above sheared blend about below the glass transition temperature (Tg) of the resin to form electrostatically bound toner size aggregates with a narrow particle size distribution;

(iv) heating said bound aggregates about above the Tg of the resin, and optionally cooling and isolating said toner particles.

In embodiments, the present invention is directed to processes for the preparation of a latex comprised of resin, water, ionic and nonionic surfactants where the resin comprises from between about 20 and about 60 percent by weight (or parts throughout) of the weight of the latex dispersion, and the surfactants comprise between about 1 percent and about 5 percent of the weight of the resin, the remainder being water, which process comprises utilizing during the latex synthesis organic, or oil soluble initiators, such as Vazo 64, 2-methyl 2-2'-azobis propanenitrile, Vazo 88, 2-2'-azobis isobutyramide dihydrate, and the like, and water soluble initiators such as potassium, sodium or ammonium persulfates. The processes suitable for the present invention in embodiments can be referred to as emulsion polymerization processes and microsuspension processes. These processes are normally distinguished by the degree to which the oil or organic phase of the reactant monomers are dispersed in the aqueous reaction medium prior to accomplishing the polymerization of the monomers to form a suspension of latex particles in water. In the emulsion polymerization process, the oil (monomer) and water phases are simply mixed under mild conditions in the presence of a surfactant solution. Growth of the polymer is believed to be nucleated in the surfactant micelles that form in the aqueous solution of surfactants; this controls the number of latex particles that are formed and thus influences the final size of the latex after the reaction is completed. Particle growth takes place as the reaction proceeds by monomers diffusing from the large oil droplets of, for example, a size greater than 1 millimeter into the micelles and reacting with the initiator and chain transfer reagents. In microsuspension polymerization, the oil (monomer) phase is homogenized in the aqueous solution of surfactant often using a cosolvent (a material soluble in the oil phase and being somewhat water soluble) forming oil in water droplets of the final desired latex size before performing the polymerization which is believed to simply polymerize the oil phase into a solid particle of the polymer dispersed in the aqueous medium. Generally, a microsuspension process does not provide a latex with as narrow a particle size distribution as does an emulsion polymerization process, however, a carefully controlled microsuspension process can provide a latex that has a particle size distribution that can be aggregated into toner sized particles of narrow particle size distribution. It is important to recognize that the surfactant neutralization process employed to prepare the aggregated toner particles described in the present process utilizes a latex with a certain surface charge; in the latex field surface charge is usually characterized by the Zeta potential of the latex which is conveniently measured using an optical microelectrophoresis apparatus at low particle concentration (approximately 10 parts of latex per million of pure deionized water). The surfactant aggregation process utilizes a latex with a Zeta potential of more than −80 millivolts, and this is achieved when water soluble initiators are used in formulating the latex, an oil soluble initiator alone does not provide this type of surface potential, more generally giving anionically stabilized latexes a Zeta potential of below −40 millivolts. The high Zeta potential of the latex involves the use of the water soluble initiators, and when such initiators are used alone in a latex formulation designed to produce low $M_w$ latex resins there results excessive undesirable formation of oligomers which impart serious deficiencies to the toner particles which are formed by the surfactant aggregation process. More specifically, the preparation of the latex comprises: in the emulsion polymerization process, the monomers are added to an aqueous surfactant solution in an amount that generates about 30 percent by weight of the mixture of monomers, the remainder being surfactant, between 1 and 5 percent by weight, and water, between about 65 and about 69 percent by weight. To this mixture is added between about 1 and about 4 percent by weight of a chain transfer agent, dodecanethiol, octanethiol or carbon tetrabromide, and between about 0.5 and about 3 percent by weight of a water soluble initiator, and between about 0.2 and about 1.5 percent of the oil soluble initiator, and wherein the water soluble initiator is dissolved in water. The mixture is then heated to about 70° C. for between about 6 and about 8 hours while stirring continuously to complete the polymerization and to form the latex suspension. The final $M_w$ of the latex is governed by the composition monomers used, from 2 to about 10 monomers throughout, although more than 10 monomers may be used in embodiments in the formulation and by the quantity of chain transfer agent that is added to the mixture. The oligomer formation is enhanced agent is agent is added; this is the situation when the desired $M_w$ of the latex is at the lower range of that achievable in the process, and more oil soluble initiator is required to ensure that the formation of oligomers is minimized in the process. In the microsuspension process the monomers are added to an aqueous surfactant solution in an amount that enables about 30 percent by weight of the monomers, the remainder being surfactant, between about 1 and about 5 percent by weight, and water, between about 65 and about 69 percent by weight. To this mixture is added between about 1 and about 4 percent by weight of a chain transfer agent, dodecanethiol, octanethiol or carbon tetrabromide, and between about 0.5 and about 3 percent by weight of a water soluble initiator, and between about 0.2 and about 1.5 percent of the oil soluble initiator. The aqueous mixture is then subjected to a high mechanical shear using a device, such as a polytron, thereby forming oil droplets in the water phase that are between about 0.1 and about 0.5 micron in volume average diameter. The emulsion is then heated to about 70° C. while continuously stirring to polymerize the monomers. A lower $M_w$ latex is formed when higher levels or amounts of chain transfer agent are used, and wherein higher amounts of oil soluble initiator are selected.

The prepared latex can then be selected for the preparation of toner compositions as illustrated herein. Thus, in embodiments, the present invention is directed to processes for the preparation of toner compositions, which comprises initially attaining or generating an ionic pigment dispersion, for example dispersing a pigment or mixture of pigments, such as carbon black, phthalocyanine or quinacridone, with a cationic surfactant, such as dodecyl ammonium chloride, by utilizing a high shearing device, such as a Brinkmann Polytron, thereafter shearing this mixture by utilizing a high shearing device, such as a Brinkmann Polytron, a sonicator or microfluidizer with a suspended latex resin mixture prepared as illustrated herein and comprised of polymer components, such as poly(styrene butadiene) or poly(styrene butylacrylate), and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant, resulting in a flocculation, or heterocoagulation of the polymer or resin particles with the pigment particles caused by the neutralization of anionic surfactant absorbed on the resin particles with the oppositely charged cationic surfactant being absorbed on the pigment particle, and further stirring the mixture using a mechanical stirrer at 250 to 500 rpm while heating below about the resin Tg, for example from about 5° to about 15° C., thereby allowing the formation of electrostatically bound aggregates of a size of from about 0.5 micron to about 10 microns; followed by heating above about the resin Tg, for example from about 5° C. to about 50° C., to cause coalescence of the latex, pigment particles, and subsequently washing with, for example, water to remove, for example, surfactant, and drying, such as by use of an Aeromatic fluid bed dryer, freeze dryer, or spray dryer, whereby toner particles comprised of resin pigment, and optional charge control additive with various particle size diameters can be obtained, such as from about 1 to about 10 microns in average volume particle diameter as measured by the Coulter Counter.

Embodiments of the present invention include a process for the preparation of toner particles comprised of resin and pigment comprising (i) preparing a pigment dispersion in water, which dispersion is comprised of a pigment, a cationic surfactant and optionally a charge control agent;

(ii) shearing the pigment dispersion with a latex mixture prepared as illustrated herein and with small or minimal amounts of oligomer as indicated herein, and which latex is comprised of polymeric or resin particles with a $M_w$ of from about 15,000 to about 40,000 and an $M_n$ of from about 3,000 to about 8,000 in water and anionic surfactant, and a nonionic surfactant; and wherein said $M_w$ is preferably from about 18,000 to about 30,000, and said $M_n$ is from about 2,000 to about 9,000;

(iii) heating the resulting homogenized mixture below about the resin Tg at a temperature of from about 35° C. to about 50° C., or 5° C. to 20° C. below the resin Tg. thereby causing flocculation or heterocoagulation of the formed particles of pigment, resin and charge control agent to form electrostatically bounded toner size aggregates;

(iv) adding an effective amount of anionic surfactant or stabilizing colloid to the electrostatically bounded toner sized aggregates prior to heating the aggregates of (iii) above the Tg of the resin, for example from about 60° C. to about 95° C. to form toner particles comprised of polymeric resin and pigment;

(v) separating the toner particles formed in step (iv) from the water by filtration and washing the particles with water to remove any surfactants remaining on the toner particle surface; and (vi) drying the toner particles by means of a spray dryer or by utilizing a counter current air drying apparatus; and wherein said resin is free of oligomers with a $M_w$ of from about 300 to about 3,000.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic acid), poly(styrene-butadiene-methacrylic acid), polyethylene-terephthalate, polypropylene-terephthalate, polybutylene-terephthalate, polypentylene-terephthalate, polyhexalene-terephthalate, polyheptadene-terephthalate, polyoctalene-terephthalate and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in volume average diameter as measured by the Brookhaven disc centrifuge particle size analyzer. Other sizes and effective amounts of resin particles may be selected in embodiments, for example copolymers of poly (styrene butylacrylate acrylic acid) or poly(styrene butadiene acrylic acid).

The toner can contain various known pigments, such as carbon blacks like REGAL 330® carbon black, magnetites, cyan, magenta, red, blur, green, brown, and yellow pigments, which pigments in embodiments are selected in various effective amounts, such as for example from about 1 to about 20 weight percent, and preferably from about 5 to about 15 weight percent, and more preferably from about 8 to about 12 weight percent. Other specific pigments are illustrated in the United States patents mentioned herein.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Components selected for the processes of the present invention are as recited herein, and as recited in the United States patents mentioned herein, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Specific surfactants in amounts of, for example, 0.1 to about 25 weight percent in embodiments include, for example, nonionic surfactants such as dialkylphenoxypoly (ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers used to prepare the copolymer resin. Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend. Examples of cationic surfactants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of stabilizers, which may in embodiments be added to the aggregated particles to retain the particle size and GSD achieved in the aggregation step when heating the aggregates above the Tg of the resin to coalesce the aggregates into toner particles, can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a stabilizing agent is, for example, from about 0.01 to about 10 percent by weight, and preferably from about 0.5 to about 5 percent by weight of the total weight of the aggregate dispersion which is comprised of latex, pigment particles, water, and ionic and nonionic surfactants.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

Of importance with respect to the present invention is the preparation of the latex particles as illustrated herein.

The following Examples are being submitted to further define various species of the present invention. These Examples are intended to be illustrative only and are not intended to limit the scope of the present invention. Also, parts and percentages are by weight unless otherwise indicated.

COMPARATIVE EXAMPLE 1

Latex Preparation (Latex A)

A latex was prepared by emulsion polymerization from monomers of styrene, butylacrylate, and acrylic acid in the proportions of 82 parts of styrene, 18 parts of butylacrylate with the addition of 2 parts per hundred of acrylic acid together with chain transfer reagents (dodecanethiol and octanethiol) at a total loading of 3 percent in an aqueous mixed surfactant (nonionic/anionic) solution with a 3 percent total surfactant loading as follows. 246 Grams of styrene, 54 grams of butyl acrylate, 6 grams of acrylic acid, 4.5 grams (1.5 percent) of dodecanethiol, and 4.5 grams of octanethiol (1.5 percent) were mixed with 600 milliliters of deionized water, which contained 4.5 grams of sodium dodecyl benzene sulfonate anionic surfactant, NEOGEN R™, which contained 60 percent of the active surfactant component, 4.5 grams of polyoxyethylene nonyl phenyl ether, a nonionic surfactant, ANTAROX 897™, with 70 percent active surfactant components. 100 Grams of water containing 3 grams (1 percent) of the water soluble ammonium persulfate initiator were added to the above mixture. The emulsion system was then polymerized at 70° C. for 8 hours. The resulting latex, which is comprised of 70 percent or parts water, contains 30 percent solid material (the latex) which was comprised of a terpolymer of polystyrene polybutyl acrylate and polyacrylic acid; the Tg of the latex dry sample was 60° C., as measured on a DuPont DSC; and had a $M_w$=25,500, and $M_n$=7,525 as determined on a Water's Gel Permeation Chromotograph (GPC). The GPC data indicates that there are a significant number of oligomers in this latex, but as no calibration for such species is known the GPC data cannot be quantified exactly. The presence of oligomers and monomer in the latex can also be inferred from the odor of the latex which has the distinct aroma of the monomers. The particle size of the latex as measured on Brookhaven disc centrifuge was 180 nanometers, and the Zeta potential of the latex was determined to be −85 millivolts using a PenKem Lazer Zee meter.

Toner Preparation Using Latex A (Cyan Pigment)

6.8 Grams of the dispersed pigment BHD6000 (Sun Chemicals), SUNSPERSE BLUE™ pigment (53 percent solids) were dispersed in 240 grams of deionized water containing 1.5 grams of alkylbenzyldimethyl ammonium chloride cationic surfactant (SANIZOL B™) by stirring. This cationic dispersion of the pigment was than simultaneously added together with 346 grams of Latex A described above (30 percent solids) to 400 grams of water while being continuously homogenized with an IKA G45M probe for 3 minutes at 5,000 rpm. This mixture was then transferred into a reaction kettle and the temperature of the kettle was raised to 50° C. for a period of 150 minutes, while stirring the reaction kettle. The volume average particle size of the aggregates obtained was 6.5 microns; these aggregates having a GSD of 1.21 as measured by the Coulter Counter. 60 Milliliters of a 20 percent (w/w) solution of the anionic surfactant sodium dodecylbenzene sulfonate were added to the aggregate suspension to prevent further growth in size of the aggregates, after which the reactor temperature was raised to 93° C. for 4 hours to complete the coalescence of the aggregates into toner particles. The particle size measurement using the Coulter Counter showed that the volume average particle size increased to 6.8 microns with a GSD of 1.23. The contents of the kettle were allowed to settle (the toner particles separate from the slurry) and the color of the supernatant was similar to that of a dispersion of the pigment. Optical observations show that much of the pigment had not been incorporated into the toner, and for a certain mass of toner the optical density was half that expected if all the pigment had been incorporated into the toner particles.

COMPARATIVE EXAMPLE 2

Latex Preparation (Latex B)

A latex was prepared by emulsion polymerization with the monomers styrene and butylacrylate in the ratio of 82:12 with the addition of 2 parts per hundred of acrylic acid and chain transfer agents at 4 percent total loading (dodecanethiol and octanethiol) in a mixed surfactant solution of nonionic and anionic surfactants (3 percent loading) as follows. 246 Grams of styrene, 54 grams of butyl acrylate, 6 grams of acrylic acid, 9 grams (3 percent) of dodecanethiol, and 3 grams of octanethiol (1.0 percent) were mixed with 600 grams of deionized water which contained 4.5 grams of sodium dodecyl benzene sulfonate anionic surfactant, NEOGEN R™, which contained 60 percent of the active component, 4.5 grams of the nonionic surfactant polyoxyethylene nonyl phenyl ether, ANTAROX 897™, which contained 70 percent of the active surfactant. 100 Grams of water containing 3 grams of ammonium persulfate initiator were then added to the above mixture. The emulsion was then polymerized at 70° C. for 8 hours. The resulting latex, 70 percent water and 30 percent (weight percent throughout) solids, was comprised of a terpolymer of styrene, butyl acrylate and polyacrylic acid; the Tg of the latex dry sample was 60° C., as measured on a DuPont DSC; and the latex had a $M_w$=20,100, and $M_n$=3,980 as determined on a Water's GPC. The GPC shows the presence of oligomers with a molecular weight of less than 2,000, for example about 1,800, but in comparison to Latex A, described above, the oligomer concentration was estimated from the GPC trace to be greater than seen for Latex A. In this regard, it was noticed that it was difficult to detect the monomer odor of Latex B whereas the odor was distinctive in Latex A. The volume average particle size of Latex B as measured on a Brookhaven disc centrifuge was 175 nanometers and the Zeta potential of the latex was measure to be −90 millivolts as measured using the PenKem Lazer Zee meter.

Toner Preparation Using Latex B (Cyan Particles)

6.8 Grams of the dispersed cyan pigment BHD6000 (from Sun Chemicals) SUNSPERSE BLUE™ pigment (53 percent solids) were dispersed in 240 grams of deionized water containing 1.5 grams of alkylbenzyldimethyl ammonium chloride cationic surfactant (SANIZOL B™) by stirring. This cationic dispersion of the cyan pigment was than simultaneously added together with 346 grams of Latex B (30 percent solids) to 400 grams of water while being homogenized with an IKA G45M probe for 3 minutes at 5,000 rpm. This mixture then was transferred to a reaction kettle and its temperature raised to 50° C. for a period of 90 minutes. The volume average particle size of the aggregate obtained was 6.5 microns, and the aggregates had a GSD of 1.28 as measured using a Coulter Counter. 60 Milliliters of an aqueous 20 percent (w/w) anionic surfactant solution were added to the aggregates, after which the reactor temperature was raised to 93° C. for 4 hours to complete the coalescence of the aggregates into toner particles. The particle size measurement showed that the volume average diameter increased to 8.0 with a particle GSD of 1.38. This increase in volume average diameter and GSD was totally attributable to an increase in the number of larger particles that formed in the coalescence step where the temperature was maintained above the resin Tg. The presence of the oligomers favored further particle growth which cannot usually be prevented by applying a quantity of stabilizer. The larger particles that were formed in this situation contributed to toners which were poorer for electrophotographic imaging than toners that do not contain the larger particles as is well known in electrophotographic imaging practice where the phenomenon is often referred to as the image degradation resulting from the "grit" effect.

EXAMPLE I

Example to illustrate, for example, the improvement in pigment retention properties of latexes prepared using dual initiator systems (one oil soluble, one water soluble) to contrast with the results provided in Comparative Example 1.

Latex Preparation (Latex C)

A latex was prepared by emulsion polymerization by repeating the process of Comparative Example 1, Latex A, except that instead of adding only 3 grams of ammonium persulfate as the water soluble initiator, 3 grams of ammonium persulfate and 2 grams of Vazo 64 oil soluble initiator were added to the mixture before performing the polymerization. The emulsion polymerization procedure was performed as follows. 246 Grams of styrene, 54 grams of butyl acrylate, 6 grams of acrylic acid, and 4.5 grams (1.5 percent) of dodecanethiol, 4.5 grams of octanethiol (1.5 percent) and 2 grams of Vazo 64 (DuPont) oil soluble initiator were mixed with 600 milliliters of deionized water which contained 4.5 grams of sodium dodecyl benzene sulfonate anionic surfactant, NEOGEN R™, which contains 60 percent of the active surfactant component, 4.5 grams of polyoxyethylene nonyl phenyl ether, and a nonionic surfactant, ANTAROX 897™, with 70 percent active surfactant components. 100 Grams of water containing 3 grams (1 percent) of the water soluble ammonium persulfate initiator were added to the above mixture. The emulsion system was then polymerized at 70° C. for 8 hours. The resulting latex, which is comprised of 70 percent water, contains 30 percent solid material (the latex) which was comprised of a terpolymer of polystyrene, polybutyl acrylate and polyacrylic acid; the Tg of the latex dry sample was 60° C., as measured on a DuPont DSC; and had a $M_w$=27,500, and $M_n$=7,850 as determined on a Water's Gel Permeation Chromotograph (GPC). The GPC data indicates that the number of oligomers of molecular weight below 2,000 in this latex was only 10 percent of the number seen in Latex A which does not utilize the oil soluble initiator. The presence of oligomers and monomer in the latex could not be detected from the odor of the latex. The particle size of the latex as measured on a Brookhaven disc centrifuge was 190 nanometers and the Zeta potential of the latex was determined to be −90 millivolts as determined using the PenKem Lazer Zee meter.

Toner Preparation Utilizing Latex C (Cyan Pigment)

6.8 Grams of the dispersed pigment BHD6000 (Sun Chemicals), SUNSPERSE BLUE™ pigment (53 percent solids) were dispersed in 240 grams of deionized water containing 1.5 gram of alkylbenzyldimethyl ammonium chloride cationic surfactant (SANIZOL B™) by stirring. This cationic dispersion of the pigment was then simultaneously added together with 346 grams of Latex C described above (30 percent solids) to 400 grams of water while being continuously homogenized with an IKA G45M probe for 3 minutes at 5,000 rpm. This mixture then was transferred into a reaction kettle and the temperature of the kettle was raised to 50° C. for a period of 150 minutes, while stirring the reaction kettle. The volume average particle size of the aggregates obtained was 6.3 microns, these aggregates have a GSD of 1.21 as measured by the Coulter Counter. 60 Milliliters of a 20 percent (w/w) solution of the anionic surfactant sodium dodecylbenzene sulfonate were added to the aggregate suspension to prevent further growth in size of the aggregates, after which the reactor temperature was raised to 93° C. for 4 hours to complete the coalescence of the aggregates into toner particles. The particle size measurement using the Coulter Counter showed that the volume average particle size remained at 6.3 with a GSD of 1.20. The contents of the kettle were allowed to settle (the toner particles separate from the slurry) and the supernatant was observed to be clear and free of loose pigment. Optical observations showed that within experimental error all the pigment had been incorporated into the toner and the optical density of a certain mass of toner was that expected if all the pigment had been incorporated into the toner particles.

EXAMPLE II

Example to illustrate the improvement in reducing the formation of larger sized toner particles made from latexes made using dual initiator systems (one oil soluble one water soluble) to contrast with the results given in Comparative Example 2.

Latex Preparation (Latex D)

A latex was prepared in the same manner as in Comparative Example 2, Latex B, except that an oil soluble initiator was added to the formulation in addition to the water soluble initiator. The latex was prepared as follows. 246 Grams of styrene, 54 grams of butyl acrylate, 6 grams of acrylic acid, 9 grams (3 percent) of dodecanethiol, 3 grams of octanethiol (1.0 percent) and 4 grams of the oil soluble initiator Vazo 88 (DuPont) were mixed with 600 grams of deionized water which contained 4.5 grams of sodium dodecyl benzene sulfonate anionic surfactant, NEOGEN R™, which contained 60 percent of the active component, 4.5 grams of the nonionic surfactant polyoxyethylene nonyl phenyl ether, ANTAROX 897™, which contained 70 percent of the active surfactant. 100 Grams of water containing 3 grams of ammonium persulfate initiator were then added to the above mixture. The emulsion was then polymerized at 70° C. for 8 hours. The resulting latex, 70 percent water and 30 percent (weight percent throughout) solids, was comprised of a terpolymer of styrene, butyl acrylate and polyacrylic acid; the Tg of the latex dry sample was 60° C., as measured on a DuPont DSC; and the latex had a $M_w$=22,000, and $M_n$=4,800 as determined on a Water's GPC. The GPC showed the presence of oligomers with a molecular weight of less than 2,000 but only in concentration of about 10 percent of the concentration seen with Latex B (as described in Comparative Example 2 above). The volume average particle size of Latex D as measured on a Brookhaven disc centrifuge was 185 nanometers; the Zeta potential of the latex was determined to be −85 millivolts using the PenKem Lazer Zee meter.

Toner Preparation Using Latex D (Cyan Particles)

6.8 Grams of the dispersed cyan pigment BHD6000 (from Sun Chemicals), SUNSPERSE BLUE™ pigment (53 percent Solids) was dispersed in 240 grams of deionized water containing 1.5 grams of alkylbenzyldimethyl ammonium chloride cationic surfactant (SANIZOL B™) by stirring. This cationic dispersion of the cyan pigment was than simultaneously added along with 346 grams of Latex D (30 percent solids) to 400 grams of water while being homogenized with an IKA G45M probe for 3 minutes at 5,000 rpm. This mixture then was transferred to a reaction kettle and its temperature raised to 50° C. for a period of 90 minutes. The volume average particle size of the aggregate obtained was 6.3 microns and the aggregates had a GSD of 1.22 as measured using a Coulter Counter. 60 Milliliters of an aqueous 20 percent (w/w) anionic surfactant solution was added to the aggregates, after which the reactor temperature was raised to 93° C. for 4 hours to complete the coalescence of the aggregates into toner particles. The particle size measurement showed that the volume average diameter was 6.3 with a particle GSD of 1.22 indicating no formation of larger sized particles in the coalescence step in contrast to results found in the Comparative Example 2. The eletrophotographic imaging behavior of this toner was found to be superior to that of the toner formed in Comparative Example 2, and this improvement can be attributed to the elimination of the larger size grit that was detected in the toner of Comparative Example 2.

EXAMPLE III

Example to illustrate that a latex made by the microsuspension process can be fabricated into narrow particle sized toners provided both oil soluble and water soluble initiators are employed in the process for making the latex.

Latex Preparation (Latex E)

A latex was prepared by microsuspension polymerization of styrene and butyl acrylate in the ratio of 82:18 with the addition of 2 parts per hundred of acrylic acid monomer. The latex was prepared as follows. 246 Grams of styrene, 54 grams of butyl acrylate, 6 grams of acrylic acid, 3 grams of dodecanethiol, 10 grams of carbon tetrabromide and 12 grams of the oil soluble initiator Vazo 88 (du Pont) were mixed with 600 grams of deionized water which contained 4.5 grams of sodium dodecyl benzene sulfonate anionic surfactant, NEOGEN R™, which contained 60 percent of the active component, 4.5 grams of the nonionic surfactant polyoxyethylene nonyl phenyl ether, ANTAROX 897™, which contained 70 percent of the active surfactant. This oil and water system was subjected to intense blending at 10,000 rpm using a polytron blender to form the microemulsion oil in water dispersion. 100 Grams of water containing 3 grams of ammonium persulfate initiator were then added to the above mixture. The emulsion was then polymerized at 70° C. for 6 hours. The resulting latex, 70 percent water and 30 percent (weight percent throughout) solids, was comprised of a terpolymer of styrene, butyl acrylate and polyacrylic acid; the Tg of the latex dry sample was 55° C., as measured on a DuPont DSC; and the latex had a $M_w$=26,000, and $M_n$=5,500 as determined on a Water's GPC. The GPC shows the presence of oligomers with a molecular weight (Mw) of less than 2,000 but only in concentration of about 10 percent of the concentration noted with Latex B (as described in Comparative Example 2 above). The volume average particle size of Latex E as measured on a Brookhaven disc centrifuge was 85 nanometers and the Zeta Potential was estimated to be −90 millivolts using the PenKem Lazer Zee meter.

Toner Preparation Using Latex E (Cyan Particles)

6.8 Grams of the dispersed cyan pigment BHD6000 (from Sun Chemicals), SUNSPERSE BLUE™ pigment (53 percent Solids) were dispersed in 240 grams of deionized water containing 1.5 grams of alkylbenzyldimethyl ammonium chloride cationic surfactant (SANIZOL B™) by stirring. This cationic dispersion of the cyan pigment was then simultaneously added along with 346 grams of Latex E (30 percent solids) to 400 grams of water while being homogenized with an IKA G45M probe for 3 minutes at 5,000 rpm. This mixture then was transferred to a reaction kettle and its temperature raised to 45° C. for a period of 90 minutes. The volume average particle size of the aggregate obtained was 5.2 microns and the aggregates had a GSD of 1.22 as measured using a Coulter Counter. 60 Milliliters of an aqueous 20 percent (w/w) anionic surfactant solution were added to the aggregates, after which the reactor temperature was raised to 93° C. for 4 hours to complete the coalescence of the aggregates into toner particles. The particle size measurement showed that the volume average diameter was 5.3 with a particle GSD of 1.22 indicating no formation of larger sized particles in the coalescence step in contrast to results found in the Comparative Example 2.

Other modifications of the present invention may occur to those skilled in the art subsequent to a review of the present application, and these modifications, including equivalents thereof, are intended to be included within the scope of the present invention.

What is claimed is:

1. A process consisting essentially of:

(i) preparing a pigment dispersion, which dispersion is comprised of a pigment, a cationic surfactant, and optionally a charge control agent;

(ii) shearing said pigment dispersion with a latex comprised of water, resin, a counterionic or anionic surfactant with a charge polarity of opposite sign to that of said cationic surfactant, and a nonionic surfactant, and wherein said latex is prepared by the addition of monomers containing a chain transfer agent and an organic soluble initiator to a water phase containing an anionic surfactant, and said nonionic surfactant, followed by the addition of a water soluble initiator, and subsequently heating;

(iii) heating the above sheared blend below about the glass transition temperature (Tg) of the resin to form electrostatically bound toner size aggregates; and (iv) heating said bound aggregates above about the Tg of the resin.

2. A process for the preparation of toner particles consisting essentially of:

(i) preparing a pigment dispersion, which dispersion is comprised of a pigment, and a cationic surfactant;

(ii) shearing said pigment dispersion with a latex comprised of water, resin, a counterionic or anionic surfactant with a charge polarity of opposite sign to that of said cationic surfactant, and a nonionic surfactant, and wherein said latex is prepared by the addition of monomers containing a chain transfer agent and an organic soluble initiator to a water phase containing an anionic surfactant, and said nonionic surfactant, followed by the addition of a water soluble initiator, and subsequently heating;

(iii) heating the above sheared blend below the glass transition temperature (Tg) of the resin to form electrostatically bound toner size aggregates with a narrow particle size distribution;

(iv) adding further anionic surfactant in an amount of from about 0.5 to about 5 weight percent;

(v) heating for a period of from about 0.5 to about 5 hours said bound aggregates above the Tg of the resin; and (vi) isolating and drying said toner particles.

3. A process in accordance with claim 2 wherein said toner particles of (vi) are comprised of resin and pigment, and wherein the resin possesses a weight average molecular weight of from about 15,000 to about 40,000.

4. A process in accordance with claim 3 wherein said resin is substantially free of oligomers.

5. A process in accordance with claim 3 wherein said resin is free of oligomers of a weight average molecular weight of from about 300 to about 3,000.

6. A process in accordance with claim 1 wherein said water soluble initiator is an inorganic persulfate.

7. A process in accordance with claim 2 wherein said water soluble initiator is an inorganic persulfate.

8. A process in accordance with claim 7 wherein said inorganic persulfate is ammonium persulfate, potassium persulfate, or sodium persulfate.

9. A process in accordance with claim 2 wherein said organic soluble initiator is an azobis compound.

10. A process in accordance with claim 9 wherein said azobis compound is 2-methyl 2-2'-azobis propanenitrile.

11. A process in accordance with claim 9 wherein said azobis compound is 2-2'azobis isobutyramide dihydrate.

12. A process in accordance with claim 2 wherein said organic soluble initiator is the azobis compound 2-methyl 2-2'-azobis propanenitrile, and wherein said inorganic persulfate is ammonium persulfate.

13. A process in accordance with claim 5 wherein the oligomer is present in an amount of from about 0.1 to about 2 weight percent, and wherein said oligomer possesses a weight average molecular weight of from about 400 to about 2,000.

14. A process in accordance with claim 2 wherein said latex contains from about 20 to about 50 weight percent of the resin, and the surfactants comprise from about 1 and to about 5 weight percent of the resin in water.

15. A process in accordance with claim 2 wherein the resin is a terpolymer of styrene acrylate acrylic acid, styrene isoprene acrylic acid, or a styrene methacrylate acrylic acid.

16. A process in accordance with claim 2 wherein the resin is a styrene butylacrylate acrylic acid terpolymer.

17. A process in accordance with claim 2 wherein the resin is a styrene, about 82 weight percent, butylacrylate, about 18 weight percent, or acrylic acid, about 2 weight percent.

18. A process in accordance with claim 1 wherein the nonionic surfactant is an alkyl-polyethylene oxide with an alkyl chain of length of between 10 and 16 carbon atoms, and the polyethylene oxide has between 20 and 60 ethylene oxide units.

19. A process in accordance with claim 1 wherein the anionic surfactant is a sodium salt of an alkyl sulfonic acid or alkyl benzyl sulfonic acid where the alkyl chain contains between 10 and 18 carbon units.

20. A process in accordance with claim 1 wherein said resin has a weight average molecular weight of from about 15,000 to about 30,000, and a number average molecular weight of from about 3,000 to about 5,000.

21. A process in accordance with claim 2 wherein the organic soluble initiator is the oil soluble initiator 2-2'-azobis isobutyramide dihydrate.

22. A process in accordance with claim 2 wherein the organic soluble initiator is the oil soluble initiator 2-methyl 2-2'-azobis propanenitrile.

23. A process in accordance with claim 2 wherein the water soluble initiator is ammonium persulfate, sodium persulfate or potassium persulfate.

24. A process in accordance with claim 2 wherein the $M_w$ of the resin is about 20,000, the $M_n$ of the resin is about 4,000, and the resin glass transition temperature is from about 55° to about 65° C.

25. A process in accordance with claim 1 wherein the resin is selected from the group consisting of poly(styrene-butadiene), poly(para-methyl styrene-butadiene), poly (meta-methylstyrene-butadiene), poly(alpha-methylstyrene-butadiene), poly(methylmethacrylate-butadiene), poly (ethylmethacrylate-butadiene), poly(propylmethacrylate-butadiene), poly(butylmethacrylate-butadiene), poly (methylacrylatebutadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene).

26. A process in accordance with claim 2 wherein the pigment is carbon black, magnetite, cyan, yellow, magenta, and mixtures thereof.

27. A process in accordance with claim 2 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge agent.

28. A process in accordance with claim 26 wherein the toner particles isolated are from about 3 to about 15 microns in average volume diameter, and the geometric size distribution thereof is from about 1.15 to about 1.30.

29. A process in accordance with claim 2 wherein heating in (iii) is from about 5° C. to about 25° C. below the Tg.

30. A process in accordance with claim 2 wherein heating in (iii) is accomplished at a temperature of from about 29° C. to about 59° C.

31. A process in accordance with claim 2 wherein the resin Tg in (iii) is from about 50° C. to about 80° C.

32. A process in accordance with claim 2 wherein heating in (iv) is from about 5° C. to about 50° C. above the Tg.

33. A process for the preparation of a latex consisting essentially of the addition of monomers containing a chain transfer agent and an organic soluble initiator to a water phase containing water, anionic surfactant, and nonionic surfactant, adding a water soluble initiator, and thereafter heating.

34. A process in accordance with claim 33 wherein said water soluble initiator is the inorganic persulfate, ammonium persulfate, potassium persulfate, or sodium persulfate, said organic soluble initiator is an azobis compound, and wherein from 2 to about 6 monomers are selected.

35. A process in accordance with claim 33 wherein said latex is prepared by (i) adding said monomers to be reacted at a concentration between about 20 to about 50 percent of the final weight of the aqueous dispersion together with between 0.5 and 5 percent by weight of a chain transfer agent or agents, and between 0.2 and 5 percent of an oil soluble initiator to an aqueous mixed surfactant solution of anionic and nonionic surfactants where the total surfactant concentration is between 0.5 and 5 percent, and thereafter adding between 1 and 5 percent of a water soluble initiator; and (ii) heating the above dispersion to between 60° C. and 80° C. while stirring gently for between about 4 and about 10 hours to form the latex as a polymerized resin in suspension.

36. A process for the preparation of a latex by a micro-suspension polymerization processes which comprises (i) adding monomers to be reacted at a concentration between 20 and 50 percent of the final weight of the aqueous dispersion together with between 0.5 and 5 percent by weight of a chain transfer agent or agents, and between 0.2 and 5 percent of an oil soluble initiator to an aqueous mixed surfactant solution of anionic and nonionic surfactants where the total surfactant concentration is between 0.5 and 5 percent;

(ii) blending the dispersion of (i) under conditions of high shear of between 5,000 and 15,000 rpm to form a fine oil in water suspension, thereafter adding between 1 and 5 percent of a water soluble initiator to this sheared emulsion; and (iii) heating the above emulsion to between 60° C. and 80° C. while stirring gently for between about 4 and about 10 hours to form the latex as a polymerized resin in suspension, or a polymerized resin in an emulsion, wherein said resin results from said monomer.

37. A process in accordance with claim 1 wherein the chain transfer agent is selected from the group consisting of dodecanethiol, octanethiol, carbon tetrabromide, and mixtures thereof.

38. A process in accordance with claim 2 wherein the chain transfer agent is selected from the group consisting of dodecanethiol, octanethiol, carbon tetrabromide, and mixtures thereof.

39. A process in accordance with claim 2 wherein a mixture of two chain transfer agents are selected.

40. A process in accordance with claim 2 wherein a mixture of two chain transfer agents octanethiol and carbon tetrabromide, or dodecanethiol and carbon tetrabromide are selected.

41. A process in accordance with claim 2 wherein at least two monomers are selected, and said heating is at a temperature of from about 60° C. to about 80° C.

42. A process in accordance with claim 2 wherein from 2 to about 10 microns are selected, and said water soluble initiator is present in water.

43. A process in accordance with claim 1 wherein said monomers are styrene, acrylate, or methacrylate.

* * * * *